US010813448B2

(12) United States Patent
Lu

(10) Patent No.: US 10,813,448 B2
(45) Date of Patent: Oct. 27, 2020

(54) HAND-OPERATED WORM GEAR HEIGHT ADJUSTABLE TABLE

(71) Applicant: Qidong Vision Mounts Manufacturing Co., Ltd, Qidong (CN)

(72) Inventor: Hairong Lu, Qidong (CN)

(73) Assignee: QIDONG VISION MOUNTS MANUFACTURING CO., LTD, Qidong (CN)

( * ) Notice: Subject to any disclaimer, the term of this patent is extended or adjusted under 35 U.S.C. 154(b) by 0 days.

(21) Appl. No.: 16/503,496

(22) Filed: Jul. 4, 2019

(65) Prior Publication Data

US 2020/0196748 A1 Jun. 25, 2020

(30) Foreign Application Priority Data

Dec. 24, 2018 (CN) ..... 2018 1 1578924

(51) Int. Cl.

| | |
|---|---|
| ***A47B 9/00*** | (2006.01) |
| ***A47B 9/16*** | (2006.01) |
| ***A47B 21/02*** | (2006.01) |

(52) U.S. Cl.

CPC ..... *A47B 9/16* (2013.01); *A47B 21/02* (2013.01); *A47B 2200/004* (2013.01)

(58) Field of Classification Search

CPC ..... A47B 9/16; A47B 21/02; A47B 2200/004
See application file for complete search history.

(56) References Cited

U.S. PATENT DOCUMENTS

| | | | | |
|---|---|---|---|---|
| 4,273,306 | A * | 6/1981 | Chang | A47B 9/16 108/145 |
| 5,996,961 | A * | 12/1999 | Johnson | A47B 9/16 248/157 |
| 10,258,143 | B1 * | 4/2019 | Kenyon | A47B 3/10 |
| 2015/0216296 | A1 * | 8/2015 | Mitchell | B62B 3/02 108/21 |
| 2017/0354245 | A1 * | 12/2017 | Martin | A47B 21/02 |
| 2018/0008037 | A1 * | 1/2018 | Laudadio | A47B 23/04 |
| 2018/0055214 | A1 * | 3/2018 | Kim | A47B 9/18 |
| 2018/0084903 | A1 * | 3/2018 | Liao | A47B 21/02 |

(Continued)

FOREIGN PATENT DOCUMENTS

| | | | | |
|---|---|---|---|---|
| CN | 208987944 U * | 6/2019 | | |
| WO | WO-2019001507 A1 * | 1/2019 | | A47B 13/02 |

*Primary Examiner* — Matthew W Ing

(74) *Attorney, Agent, or Firm* — Bayramoglu Law Offices LLC

(57) ABSTRACT

A hand-operated worm gear height adjustable table includes a table top, a base mechanism, a lift mechanism, and a driving mechanism. The base mechanism includes a base and tracks on the base. The lift mechanism includes two parallel first lift arms and two parallel second lift arms which cross with each other to form X-shaped structures. The driving mechanism is connected to the upper ends of the first lift arms and includes two U-shaped slide rails and a driving shaft penetrating through the upper ends of the first lift arms. The center of the driving shaft is provided with a worm gear and a worm. The outer end surface of the worm is sleeved with a first sleeve component and a second sleeve component with a cavity provided therebetween, and the outer end surface of the first sleeve component is sleeved with the first torsional spring.

11 Claims, 7 Drawing Sheets

(56) References Cited

U.S. PATENT DOCUMENTS

| | | | | |
|---|---|---|---|---|
| 2018/0184797 | A1* | 7/2018 | Chuang | A47B 9/16 |
| 2018/0255919 | A1* | 9/2018 | Swartz | A47B 9/16 |
| 2020/0029683 | A1* | 1/2020 | Xiang | A47B 23/043 |

* cited by examiner

HAND-OPERATED WORM GEAR HEIGHT ADJUSTABLE TABLE

CROSS REFERENCE TO RELATED APPLICATIONS

This application is based upon and claims priority to Chinese Patent Application No. 201811578924.4, filed on Dec. 24, 2018 the entire contents of which are incorporated herein by reference.

TECHNICAL FIELD

The present invention relates to a hand-operated worm gear height adjustable table.

BACKGROUND

In recent years, with the rapid development and popularization of the computer technology, more and more people suffer from diseases as they use the computer frequently. The frequent use of the computer day after day not only causes poor eyesight, but also causes cervical spondylosis, lumbar spondylosis and so on. To reduce the occurrence of these diseases, on one hand, people should pay attention to balance between work and rest, on the other hand, people should keep correct body posture while working. The accessories of the electronic devices such as computers, laptops, and IPADs always include tables and chairs. Sitting for long periods of time while at work will cause occupational diseases. To this end, height adjustable tables were launched in the market recently to satisfy the requirements of alternating between sitting and standing while at work and entertainment.

However, the existing height adjustable tables usually have the following drawbacks. 1. The driving mechanism of the existing height adjustable tables uses an actuator to drive the lift arms to achieve the height adjustment of the table top, and a locking mechanism is used to lock and stop the movement. The structure of the existing tables is complicated and cumbersome. Moreover, the actuator is a long-travel actuator which has higher cost. 2. Since the actuator itself has a thrust, a user just need to gently lift the table top to lift the table; while when one wants to reduce the height of the table top, a larger force should be applied on the table top to make it move downward with the influence of thrust of the actuator, so the comfort of using the table is reduced, and it is not suitable for female users. 3. Since the traditional height adjustable tables need users to apply a force on the table top, if the table is lifted high, it is inconvenient for the users to adjust the height under this situation, so the convenience of height adjustment is reduced. 4. In the existing height adjustable tables, two ends of the keyboard holder are connected to the table top by screws, respectively, so as to facilitate the assembling and disassembling. However, since the connection joint is instable, the bolts get loosened easily during the use and one often needs to tighten the bolts. Moreover, during the assembling and disassembling, the bolts on two sides must be tightened at the same time, making it inconvenient to operate.

Therefore, it's necessary to develop a height adjustable table where the driving structure of the traditional actuator is changed. By doing so, a wider movement range in height can be provided, and a convenient adjustment can be achieved. After searching, there is no such a patent in the prior art.

SUMMARY

It's therefore an objective of the present invention to provide a hand-operated worm gear height adjustable table to overcome the drawbacks in the prior art, which not only can change the driving structure of the traditional actuator, but also can achieve the effects of wider movement range, convenient adjustment, and improved experience.

To solve the above technical problems, the present invention uses the following technical solutions. A hand-operated worm gear height adjustable table includes:

a table top;

a base mechanism, in which the base mechanism includes a base placed under the table top, and two opposite inner side surfaces of the base are provided with tracks recessed inward;

a lift mechanism, in which the lift mechanism includes two parallel and correspondingly provided first lift arms and two parallel and correspondingly provided second lift arms; lower ends of the first lift arms are movably hinged with the base and upper ends of the first lift arms slide along a lateral direction of the table top on a lower end surface of the table top; the upper ends of the second lift arms are movably hinged with the lower end surface of the table top and the lower ends of the second lift arms slide in the tracks of the base; the second lift arms are placed at outer sides of the first lift arms, respectively; each first arm and a corresponding second arm cross with each other to form an X-shaped structure; and a driving mechanism, in which the driving mechanism is connected to the upper ends of the first lift arms, the driving mechanism includes two U-shaped slide rails with openings oppositely configured and a driving shaft penetrating through the upper ends of the first lift arms; two ends of the driving shaft are sleeved with rollers, and the rollers slide in the slide rails; a center of the driving shaft is provided with a worm gear and a worm rotatably connected to the worm gear, and an extending direction of the worm is perpendicular to an extending direction of the driving shaft; an end of the worm is connected to the lower end surface of the table top through an L-shaped fixing base, an outer end surface of the worm at an inner side of the fixing base is sleeved with a first sleeve component and a second sleeve component, and the first sleeve component and a second sleeve component are sleeved with each other; the second sleeve component is connected to an inner side end surface of the L-shaped fixing base, and the first sleeve component is of a stepped structure; there is a cavity between the first sleeve component and the second sleeve component, and an outer end surface of the first sleeve component placed inside the cavity is sleeved with a first torsional spring; the second sleeve component is provided with a torsional spring limit groove which enables one end of the torsional spring to stretch out and draw back, and an other end of the worm is connected to a retractable handle component.

One further improvement of the present invention is that, the retractable handle component includes a sleeve tube connected to an end of the worm away from the first torsional spring and a handle sleeved with the sleeve tube, and an interior of the sleeve tube is provided with a hexagonal inner hole orientating in an extending direction of the sleeve tube. The handle is provided with a hexagonal rod matching with the hexagonal inner hole, and a limit sleeve is sleeved outside the sleeve tube. A limit clamping member is arranged outside the limit sleeve, and an axis pin successively passing through the limit clamping member, the limit sleeve, and the sleeve tube is provided. A support bar vertically passing through the limit sleeve until reaching an interior of the limit clamping member is provided, and the support bar is perpendicular to the axis pin. A first spring is provided between a side end of the limit clamping member and the outer side end surface of the limit sleeve, and a limit bar a is provided on the other side end of the limit clamping member. The limit bar a successively passing through the limit sleeve and the sleeve tube until reaching an outer side edge of hexagonal rod. The outer side edge of hexagonal rod is provided with several limit grooves. The limit bar a matches with the limit grooves, and a limit bar b extending outward is provided on the hexagonal bar. Further, the sleeve tube is provided with a strip-shaped limit hole for embedding the limit bar b.

One further improvement of the present invention is that an outer side end surface of the handle is provided with a strip-shaped concave groove, and the concave groove is internally provided with a rotatable adjusting bar.

One further improvement of the present invention is that a front side of the table top is provided with a keyboard holder, each of the sides of the keyboard holder is provided with a Z-shaped connecting plate, and the Z-shaped connecting plate is detachably connected to the table top through a connecting assembly.

One further improvement of the present invention is that the connecting assembly includes a connector connected to the lower end surface of the table top and a rotating shaft horizontally penetrating through the connecting plate. An upper end of the connecting plate is horizontally inserted into the connector. A lower side of the connector is provided with a notch for embedding the rotating shaft. A stopper block, a sleeve ring, and a second spring are successively sleeved outside the rotating shaft. The stopper block is closely fit with a side end surface of the connecting plate, and a clamping block is sleeved outside the sleeve ring. The clamping block is in contact with the stopper block. An end of the rotating shaft away from the connector is provided with an adjusting knob, and an inner side of the adjusting knob is provided with two first protrusions along a circumference. A side end surface of the clamping block close to the adjusting knot is oppositely provided with two arc-shaped second protrusions. The two second protrusions form a circle structure, and a gap is provided between the two second protrusions for clamping the first protrusion. An end of each of the two second protrusions corresponding to the first protrusion is provided with a guide slope.

One further improvement of the present invention is that a sliding shaft penetrating through the lower ends of the two second lift arms is provided, and two ends of the sliding shaft are placed in the two tracks of the base. Check rings are sleeved outside both ends of the sliding shaft. The check rings are closely fit with an inner side end surface of the base, and the base is internally provided with cushions at positions corresponding to the two ends of the sliding shaft.

One improvement of the present invention is that each cushion is provided with a notch at a position corresponding to the check ring for embedding the check ring.

One further improvement of the present invention is that each first lift arm and the corresponding second lift arm are movably connected to each other through a buffer resistance component.

One further improvement of the present invention is that the buffer resistance component is a second torsional spring.

One improvement of the present invention is that the buffer resistance component is an actuator.

Compared with the prior art, the present invention has the following advantages.

1. In the present invention, the driving mode of the traditional actuator is changed, and the height adjustment of the table top is realized by using worms and worm gears. The worm is connected to the hand-operated retractable handle component, which not only can obtain a broader movement range, but also can realize a convenient adjustment and an improved experience, thus it's suitable for female users. The configuration of the first torsional spring at the side end of the worm prevents the weight of the table top and items on the table from causing the transmission of the worm gear and the worm and thus leading to undesired descent of the table top. The first torsional spring is connected to the worm through the first sleeve component and the second sleeve component to ensure the connection stability between the first torsional spring and the worm. Additionally, to prevent the first torsional spring from rotating and reducing the force against the descent of the table top, the torsional spring limit groove is provided to limit the position of the first torsional spring. The first torsional spring provides a resistance against the descent force of the table top, so the height adjustable table is more stable for use.

2. With a clever design for the retractable handle component, the retraction of the handle can be realized by pressing the limit clamping member. The handle can be hidden after the height adjustment of the height adjustable table, so as to improve aesthetic effect and save space. And, during the height adjustment of the height adjustable table, the handle can be pulled out, so the user experience is improved.

3. The configuration of adjusting bar on handle provides more convenience for the user to adjust the handle, so as to rotate the worm, thereby realizing the transmission between the worm and the worm gear. Besides, the adjusting bar is rotatably provided in the concave groove for an easy storage of the adjusting bar.

4. Other than the traditional screw connection, the Z-shaped connecting plate is detachably connected to the table top through connecting components, which avoids loosening during use. Moreover, the assembling and disassembling are convenient without the need to fasten or loosen the bolt, and one only needs to rotate the adjusting knob to disassemble and assemble the keyboard holder.

DETAILED DESCRIPTION OF THE EMBODIMENTS

For better understanding, the present invention will be described in detail hereinafter with reference to the drawings and embodiments. The embodiments are merely used to illustrate the present invention rather than limit the scope of the present invention.

Figure 1:
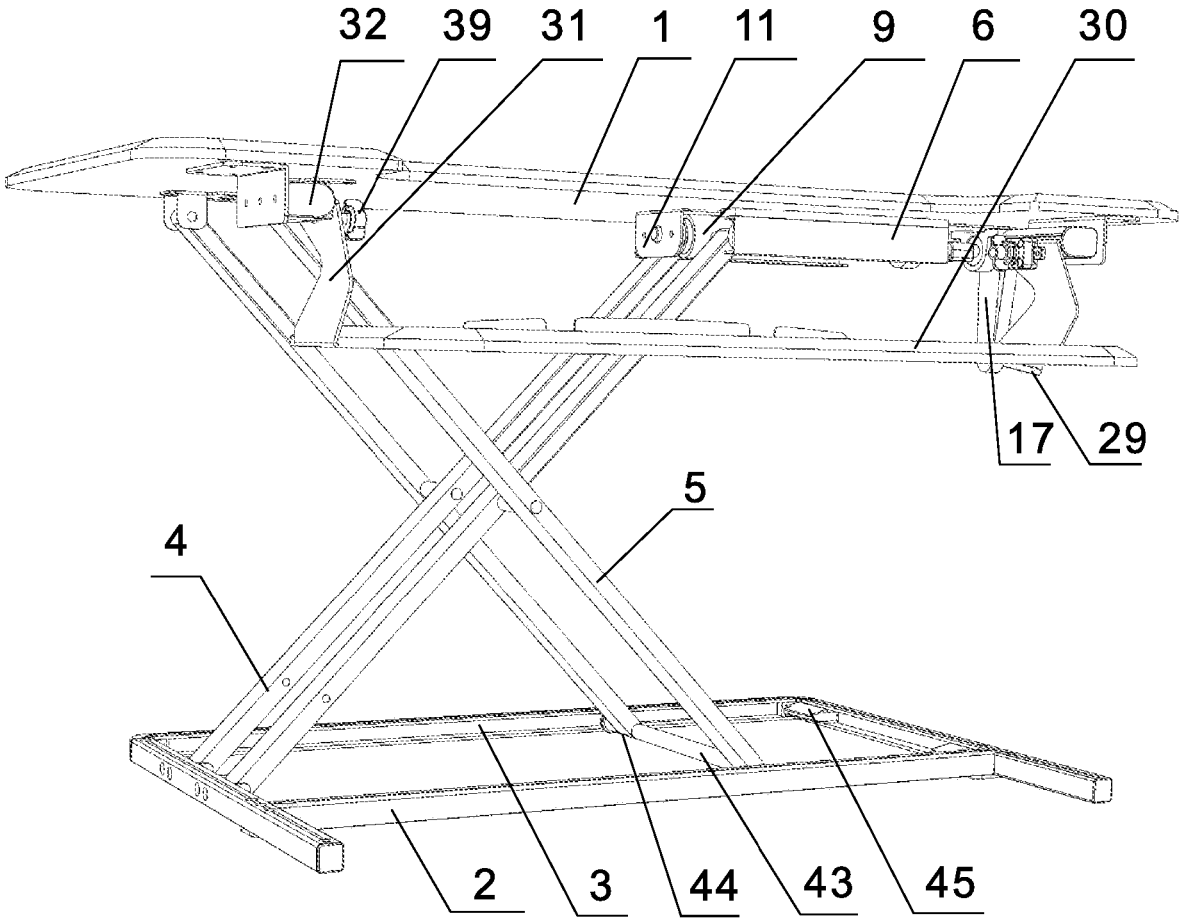
FIG. 1 shows the structure of the first embodiment of the present invention.
Figure 2:
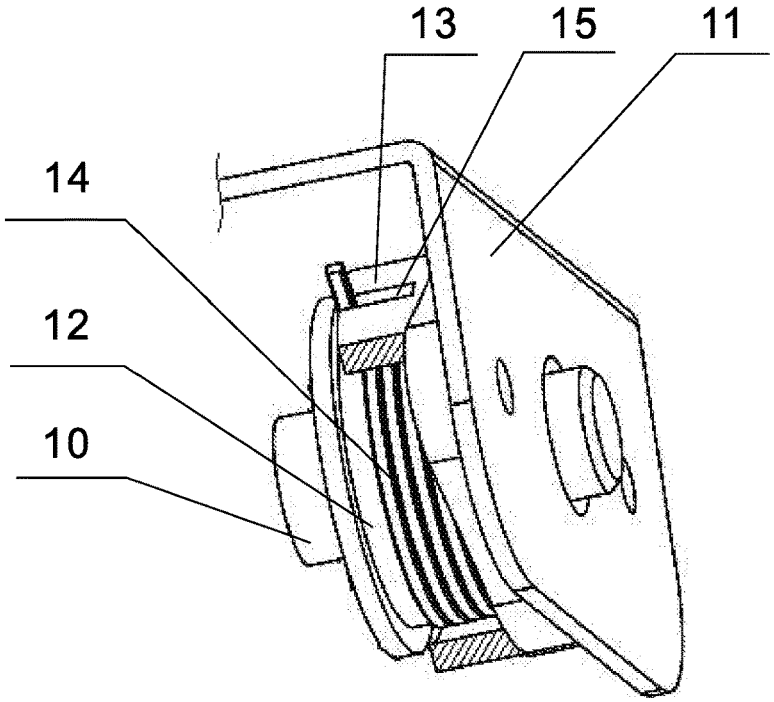
FIG. 2 is a partial sectional view showing a connection of the first torsional spring and a worm shown in the FIG. 1.
Figure 3:
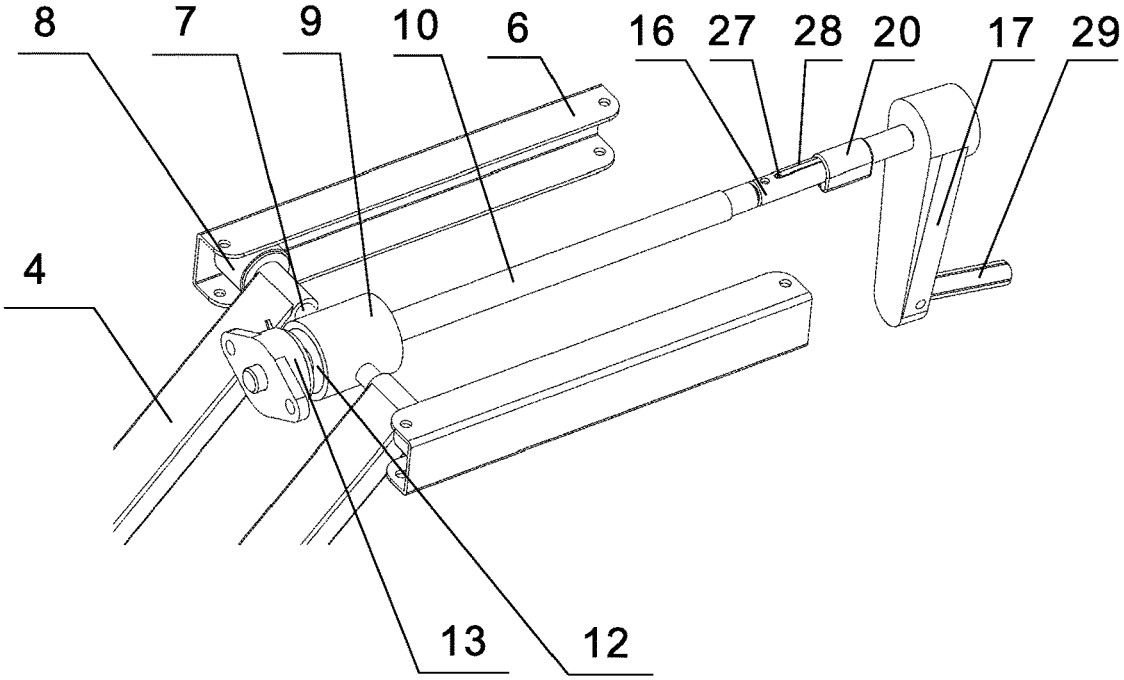
FIG. 3 is a diagram showing the connection of a worm gear, a worm, and a retractable handle component shown in the FIG. 1.

FIG. 1 shows a hand-operated worm gear height adjustable table according to the first embodiment of the present invention, which includes: the table top 1;

a base mechanism, in which the base mechanism includes the base 2 placed under the table top 1, and two opposite inner sides of the base 2 are provided with the tracks 3 recessed inward;

a lift mechanism, in which the lift mechanism includes two parallel and correspondingly provided first lift arms 4 and two parallel and correspondingly provided second lift arms 5; lower ends of the first lift arms 4 are movably hinged with the base 2 and upper ends of the first lift arms 4 slide along a lateral direction of the table top 1 on a lower end surface of the table top 1; the upper ends of the second lift arms 5 are movably hinged with the lower end surface of the table top 1 and the lower ends of the second lift arms 5 slide in the tracks 3 of the base 2; the second lift arms 5 are placed at outer sides of the first lift arms 4, respectively; each first arm 4 and the corresponding second arm 2 cross with each other to form an X-shaped structure; and a driving mechanism, in which the driving mechanism is connected to upper ends of the first lift arms 4, the driving mechanism includes two U-shaped slide rails 6 with openings oppositely configured and the driving shaft 7 penetrating through the upper ends of the first lift arms 4; two ends of the driving shaft 7 are sleeved with the rollers 8, and the rollers 8 slide in the slide rails 6; a center of the driving shaft 7 is provided with the worm gear 9 and the worm 10 rotatably connected to the worm gear 9, and an extending direction of the worm 10 is perpendicular to an extending direction of the driving shaft 7. As shown in FIG. 2, an end of the worm 10 is connected to the lower end surface of the table top 1 through the L-shaped fixing base 11, an outer end surface of the worm 10 at an inner side of the fixing base 11 is sleeved with the first sleeve component 12 and the second sleeve component 13, and the first sleeve component 12 and the second sleeve component 13 are sleeved with each other. The second sleeve component 13 is connected to an inner side end surface of the L-shaped fixing base 11 and the first sleeve component 12 is of a stepped structure. There is a cavity between the first sleeve component 12 and the second sleeve component 13, and an outer end surface of the first sleeve component 12 placed inside the cavity is sleeved with the first torsional spring 14. The second sleeve component 13 is provided with the torsional spring limit groove 15 which enables one end of the torsional spring 14 to stretch out and draw back, and an other end of the worm 10 is connected to a retractable handle component.

During use, the retractable handle component is rotated to cause a transmission of the worm 10 and the gear 9, so as to drive the driving shaft 7 at the upper ends of the first lift arms 4 to slide in the slide rails 6 on the lower end surface of the table. Accordingly, the lower end of the second lift arms 5 are driven to slide in the tracks 3 to achieve the height adjustment of the table top 1. According to the present invention, the driving mode of the traditional actuator is changed, and the height adjustment of the table top 1 is realized by using the worm gear and the worm. The worm 10 is connected to the hand-operated lift retractable handle, so not only a broader movement range can be obtained, but also a convenient adjustment and an improved experience can be achieved, thus it's suitable for female users. The configuration of the first torsional spring 14 at the side end of the worm 10 prevents the weight of the table top 1 and items on the table top 1 from causing the transmission of the worm gear 9 and the worm 10, and thus leading to undesired descent of the table top. The first torsional spring 14 is connected to the worm 10 through the first sleeve component 12 and the second sleeve component 13 to ensure the connection stability between the first torsional spring 14 and the worm 10. Additionally, to prevent the first torsional spring 14 from rotating and reducing the force against the descent of the table top, the torsional spring limit groove 15 is provided to limit the position of the first torsional spring 14. The first torsional spring 14 provides a resistance against the descent force of the table top 1, so the height adjustable table is more stable for use.

Figure 4:
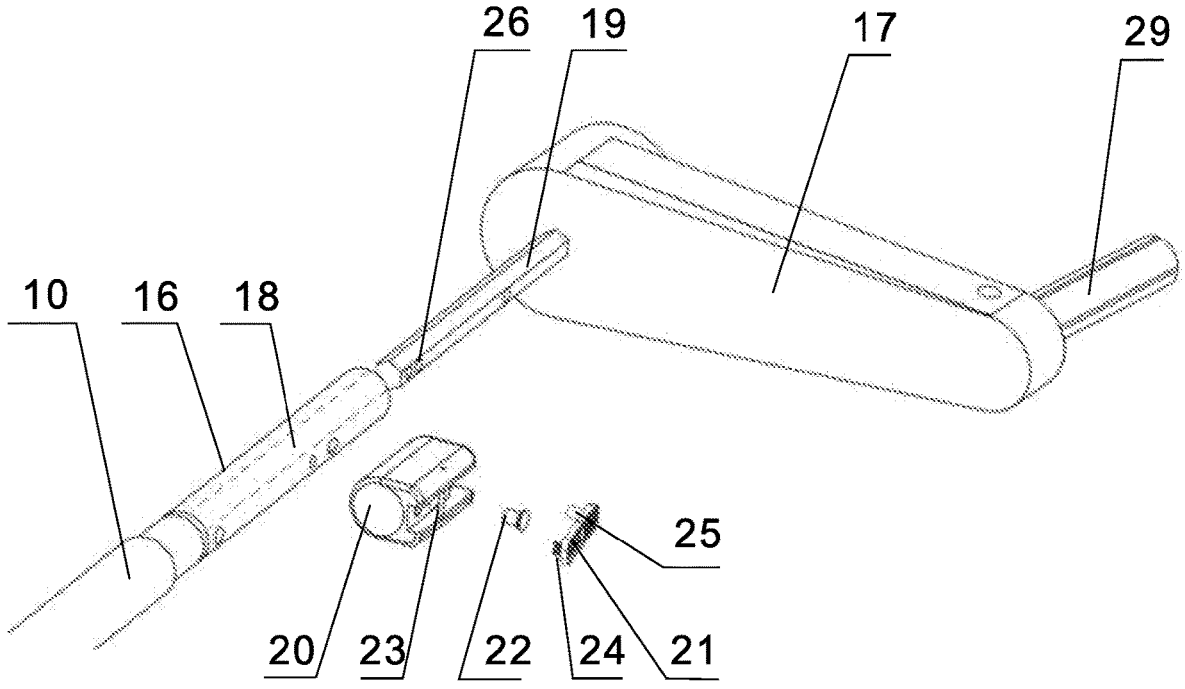
FIG. 4 is a partially exploded diagram of the retractable handle component shown in the FIG. 1.

Further, as shown in FIG. 4, the retractable handle component includes the sleeve tube 16 connected to an end of the worm 10 away from the first torsional spring 14 and the handle 17 sleeved with the sleeve tube 16, and an interior of the sleeve tube 16 is provided with the hexagonal inner hole 18 orientating in an extending direction of the sleeve tube 16. The handle 17 is provided with the hexagonal rod 19 matching with the hexagonal inner hole 18, and limit sleeve 20 is sleeved outside the sleeve tube 16. The limit clamping member 21 is arranged outside the limit sleeve 20, and the axis pin 22 successively passing through the limit clamping member 21, the limit sleeve 20, and the sleeve tube 16 is provided. The support bar 23 vertically passing through the limit sleeve 20 until reaching an inside of the limit clamping member 21 is provided, and the support bar 23 is perpendicular to the axis pin 22. The first spring 24 is provided between a side end of the limit clamping member 21 and the outer side end surface of the limit sleeve 20, and a limit bar a25 is provided on the other side end of the limit clamping member 21. The limit bar a25 successively passing through the limit sleeve 20 and the sleeve tube 16 until reaching an outer side edge of hexagonal rod 19. The outer side edge of hexagonal rod 19 is provided with several limit grooves 26. The limit bar a25 matches with the limit grooves 26, and a limit bar b27 extending outward is provided on the hexagonal bar 19. Further, the sleeve tube 16 is provided with a strip-shaped limit hole 28 for embedding the limit bar b27. Under an elastic force of the first spring 24, limit clamping member in normal state, the limit bar a25 of the limit clamping member 21 abuts the limit groove 26 to limit the position. The axis pin 22 fixes the limit sleeve 20 and the sleeve tube 16, and the support bar 23 locates the limit clamping member 23 and the limit sleeve 20 in the vertical direction. By pressing the first spring end of the limit clamping member 21, the limit bar a25 gets detached from the limit groove 26. In this case, the hexagonal bar 19 is enabled to slide in the sleeve tube 16 while the limit bar b27 slides in the limit hole 28, so as to realize the stretching and retracting of the hexagonal bar 19. After the height adjustment of the height adjustable table, the handle is hidden to improve aesthetic effect and save space. While, during the height adjustment, the handle is pulled out to improve the user experience. The hexagonal bar 19 and the hexagonal hole 18 are designed with a hexagonal structure to prevent the hexagonal bar 19 from rotating in the hexagonal hole 18, so as to limit the position after the stretching and retracting.

Further, the outer side end surface of the handle 17 is provided with a strip-shaped concave groove. The concave groove is provided with the rotatable adjusting bar 29. By configuring the adjusting bar 29 on the handle 17, it is convenient for users to adjust the handle, so as to rotate the worm 10 to cause the transmission of the worm 10 and the worm gear 9. And by rotatably configuring the adjusting bar 29 in the concave groove, it is convenient for the storage of the adjusting bar 29.

Figure 5:
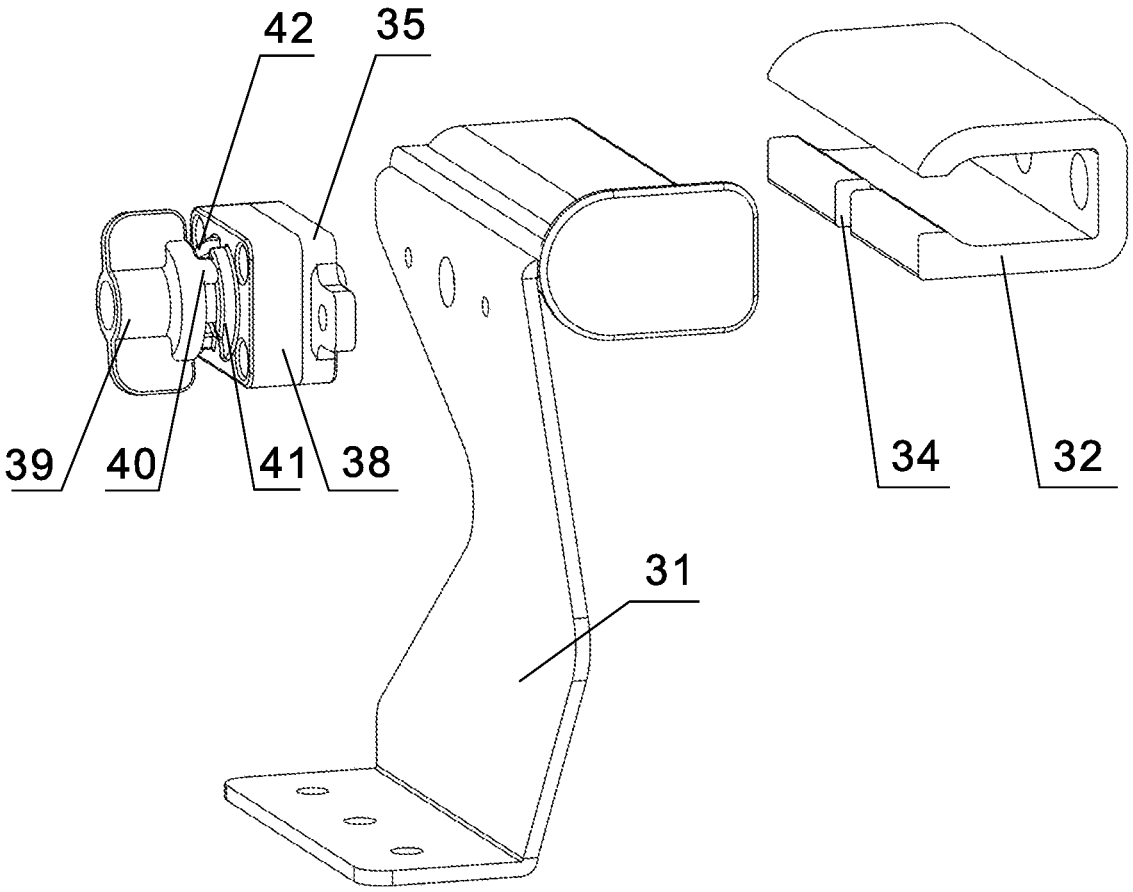
FIG. 5 is an exploded diagram of the connection of the connecting plate and connecting component shown in the FIG. 1.

Further, as shown in FIG. 5, the front side of the table top 1 is provided with the keyboard holder 30. Both sides of the keyboard holder 30 are provided with the Z-shaped connecting plates 31, and the Z-shaped connecting plates 31 are detachably connected to the table top 1 through a connecting assembly.

Figure 6:
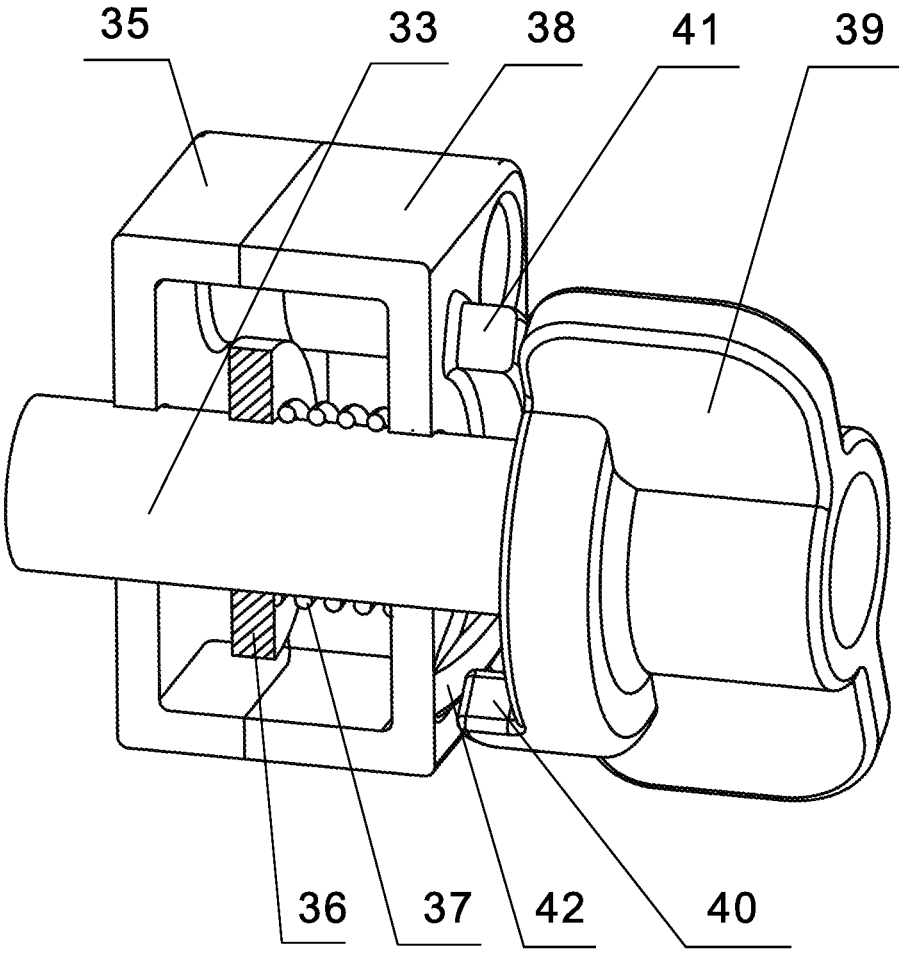
FIG. 6 is an internal schematic diagram of a connecting component shown in the FIG. 1.

The connecting assembly includes the connector 32 connected to the lower end surface of the table top 1 and the rotating shaft 33 horizontally penetrating through the connecting plate 31. An upper end of the connecting plate 31 is horizontally inserted into the connector 32. A lower side of the connector 32 is provided with the notch 34 for embedding the rotating shaft 33. As shown in FIG. 6, the stopper block 35, the sleeve ring 36, and the second spring 37 are successively sleeved outside the rotating shaft 33. The stopper block 35 is closely fit with a side end surface of the connecting plate 31, and a clamping block 38 is sleeved outside the sleeve ring 36. The clamping block 38 is in contract with the stopper block 35. An end of the rotating shaft 33 away from the connector 32 is provided with an adjusting knob 39, and an inner side of the adjusting knob 39 is provided with two first protrusions 40 along a circumference. A side end surface of the clamping block 38 close to the adjusting knot 39 is oppositely provided with two arc-shaped second protrusions 41. The two second protrusions 41 form a circular structure, and a gap is provided between the two second protrusions 41 for clamping the first protrusion 40. An end of each of the two second protrusions 41 corresponding to the first protrusion 40 is provided with a guide slope 42.

When assembling or disassembling the keyboard holder 30, the adjusting knob 39 is rotated to pass by the guide slope 42. When the first protrusion 40 contacts the second protrusion 41, the rotating shaft 33 gets detached from the notch 34 on the connector 32, and the keyboard holder 30 can be disassembled by completely dismounting the Z-shaped connecting plates 31 from the connector 32. During the assembling, the whole connecting plate 31 is inserted into the connector 32, then rotate the adjusting knob 39 to make the first protrusion 40 move to the gap between the two second protrusions 41, then the rotating shaft 33 is clamped in the notch 34 to complete the installation.

Further, the sliding shaft 43 penetrating through the lower ends of the two second lift arms 5 are provided. The two ends of the sliding shaft 43 are both provided in the two tracks 3 of the base 2. The check rings 44 are sleeved outside both ends of the sliding shaft 43, and the check rings are closely fit with the inner side end surface of the base 2. The base 2 is internally provided with the cushions 45 at positions corresponding the two ends of the sliding shaft 43. Each cushion 45 is provided with a notch at a position corresponding to the check ring 44 for embedding the check ring 44. By providing the sliding shaft 43 penetrating through the lower ends of the two second lift arms 5, the two second lift arms 5 can be kept in the same pace during lifting. By sleeving the check rings 44 outside both ends of the sliding shaft 43, the leftwards and rightwards movement of the sliding shaft 43 can be avoided. Preferably, each cushion 45 is provided with a notch at a position corresponding to the check ring 44 for embedding the check ring 44. When the check rings 44 on the sliding shaft 43 slide to the cushion 45, the check rings 44 are subjected to the buffering force the cushion 45 and can be clamped in the notch to ensure a certain stability of the table top 1 at the lowest position.

Further, each first lift arm 4 and the corresponding second lift arm 5 are movably connected to each other through a buffer resistance component.

Figure 7:
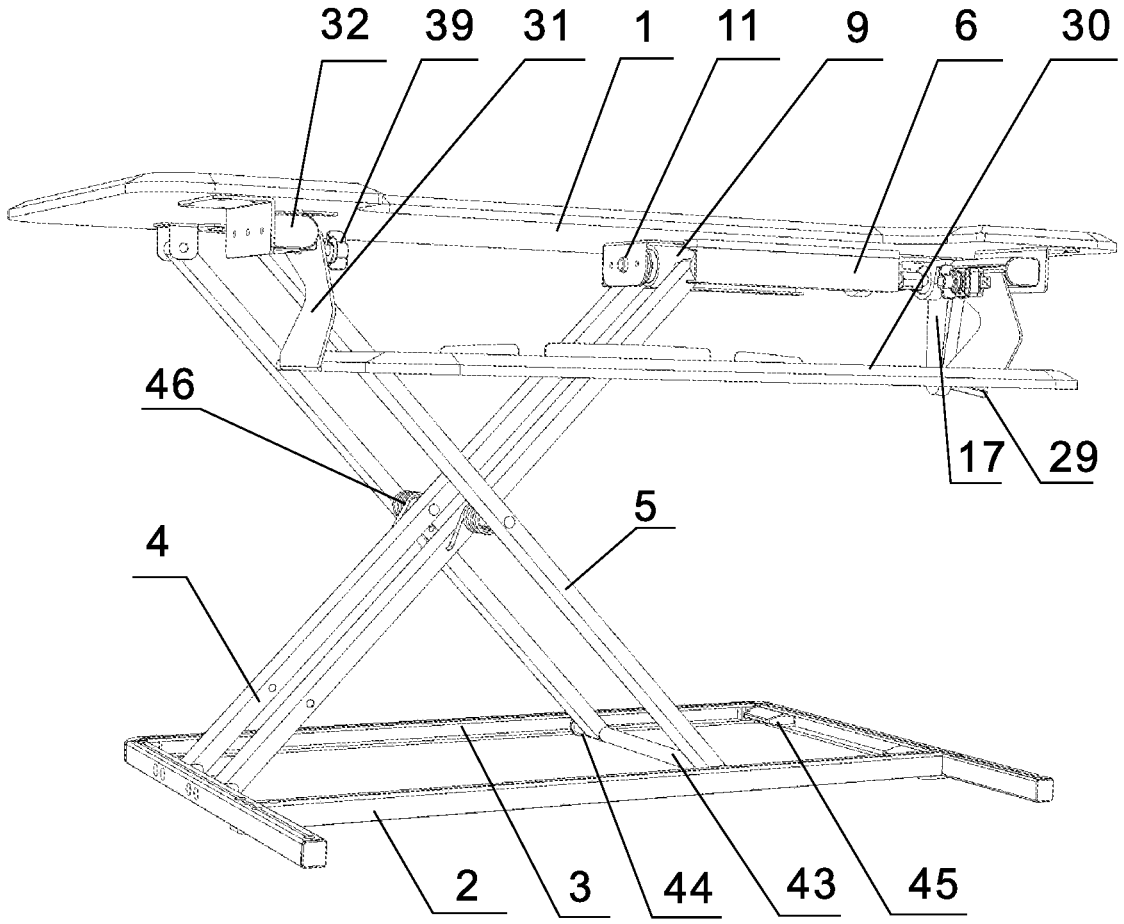
FIG. 7 is a structural diagram of the second embodiment of the present invention.

The second embodiment is shown in the FIG. 7. The buffer resistance component is the second torsional spring 46. Each first lift arm 4 and the corresponding second lift arm 5 are movably connected to each other through the second torsional spring 46. On the basis of the first torsional spring 14, each first lift arm 4 and the corresponding second lift arm 5 are movably connected to each other through the second torsional spring 46. The combination of the first torsional spring 14 and the second torsional spring 46 improves the stability of the whole height adjustable table and overcomes the inherent resistance of the height adjustable table to a great extent.

Figure 8:
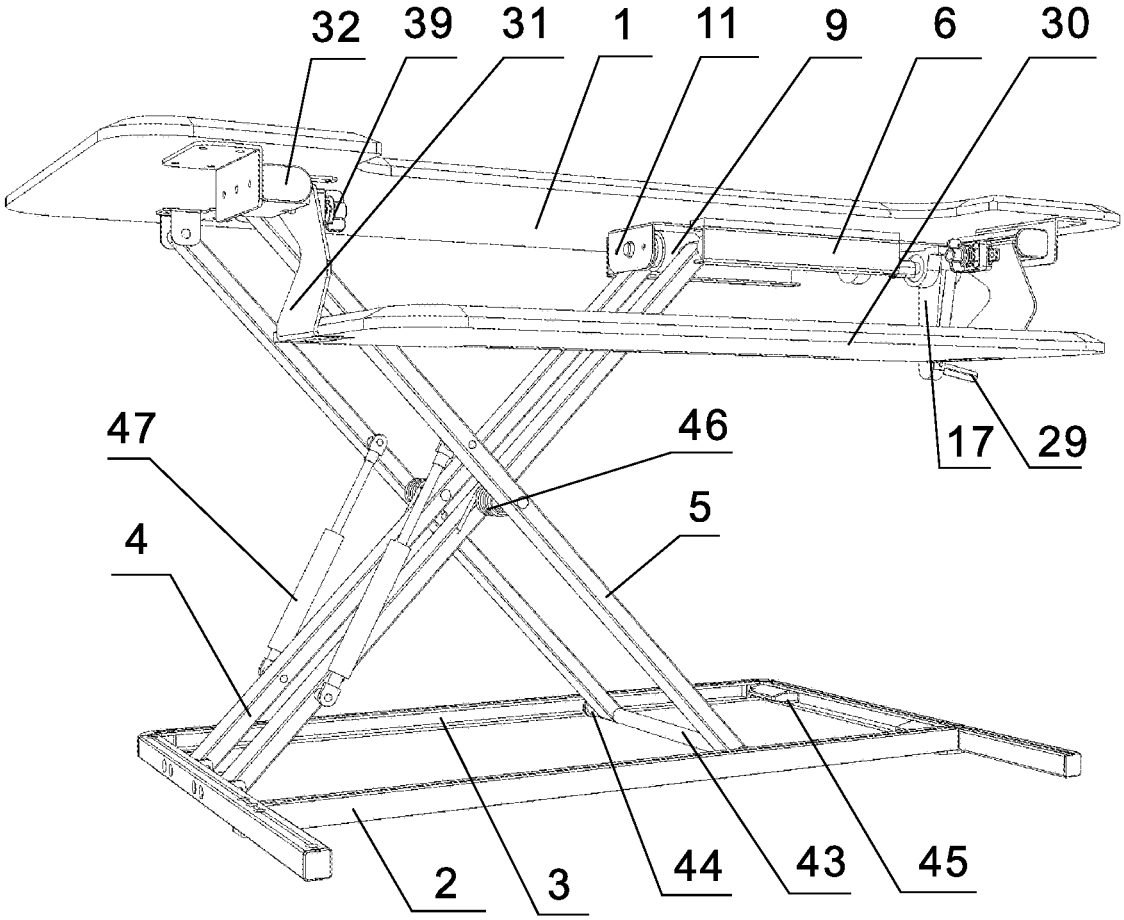
FIG. 8 is a structural diagram of the third embodiment of the present invention.

The third embodiment is shown in FIG. 8. The buffer resistance component is the actuator 47, and the actuator 47 is provided between each first lift arm 4 and the corresponding second lift arm 5. On the basis of the torsional spring 14, the second torsional spring 46 can be substituted with the actuator 7. The combination of the actuator 47 and the first torsional spring 14 improves the stability of the height adjustable table, and the combination of the first torsional spring 14, the second torsional spring 46, and the actuator 47 has the best effect on improving the stability of the height adjustable table. However, since the actuator 47 is costly, the installation of the second torsional spring 46 and the actuator 47 depends on the use requirement of the users and the load of the table.

Those skilled in the art should understand that the present invention is not limited by the above-mentioned embodiments. The above-mentioned embodiments and summary merely describe the principles of the present invention. Various variations and improvements may be derived without departing from the spirit and scope of the present invention, and these variations and improvements should be considered as falling within the scope of the present invention. The scope of the present invention is defined by the appended claims and the equivalents thereof.

What is claimed is:

1. A hand-operated worm gear height adjustable table comprising:

a table top;

a base mechanism, wherein the base mechanism comprises a base placed under the table top, and two opposite inner side surfaces of the base are provided with tracks recessed inward;

a lift mechanism, wherein the lift mechanism comprises two parallel first lift arms and two parallel second lift arms; lower ends of the first lift arms are movably hinged with the base and upper ends of the first lift arms slide along a lateral direction of the table top on a lower end surface of the table top; upper ends of the second lift arms are movably hinged with the lower end surface of the table top, and lower ends of the second lift arms slide in the tracks of the base; the second lift arms are placed at outer sides of the first lift arms, respectively; each first arm and a corresponding second arm cross with each other to form an X-shaped structure; and a driving mechanism, wherein the driving mechanism is connected to the upper ends of the first lift arms, the driving mechanism comprises two U-shaped slide rails with openings of a U shape oppositely configured and a driving shaft penetrating through the upper ends of the first lift arms; two ends of the driving shaft are sleeved with rollers, and the rollers slide in the slide rails; a center of the driving shaft is provided with a worm gear and a worm rotatably connected to the worm gear, and an extending direction of the worm is perpendicular to an extending direction of the driving shaft; an end of the worm is connected to the lower end surface of the table top through an L-shaped fixing base, an outer end surface of the worm at an inner side of the fixing base is sleeved with a first sleeve component and a second sleeve component, and the first sleeve component and the second sleeve component are sleeved with each other; the second sleeve component is connected to an inner side end surface of the L-shaped fixing base, and the first sleeve component is of a stepped structure; a cavity is provided between the first sleeve component and the second sleeve component, and an outer end surface of the first sleeve component placed inside the cavity is sleeved with a first torsional spring; the second sleeve component is provided with a torsional spring limit groove which enables one end of a torsional spring to stretch out and draw back, and an other end of the worm is connected to a retractable handle component.

2. The hand-operated worm gear height adjustable table according to claim 1, wherein the retractable handle component comprises a sleeve tube connected to an end of the worm away from the first torsional spring and a handle sleeved with the sleeve tube;

an interior of the sleeve tube is provided with a hexagonal inner hole orientating in an extending direction of the sleeve tube, the handle is provided with a hexagonal rod matching with the hexagonal inner hole, and a limit sleeve is sleeved outside the sleeve tube;

a limit clamping member is arranged outside the limit sleeve, and an axis pin successively passing through the limit clamping member, the limit sleeve, and the sleeve tube is provided;

a support bar vertically passing through the limit sleeve until reaching an interior of the limit clamping member is provided, and the support bar is perpendicular to the axis pin;

a first spring is provided between a side end of the limit clamping member and an outer side end surface of the limit sleeve, and a first limit bar is provided on an other side end of the limit clamping member; and the first limit bar successively passing through the limit sleeve and the sleeve tube until reaching an outer side edge of hexagonal rod, the outer side edge of hexagonal rod is provided with several limit grooves, the first limit bar matches with the limit grooves, a second limit bar extending outward is provided on the hexagonal bar, and the sleeve tube is provided with a strip-shaped limit hole for embedding the second limit bar.

3. The hand-operated worm gear height adjustable table according to claim 2, wherein an outer side end surface of the handle is provided with a strip-shaped concave groove, and the concave groove is internally provided with a rotatable adjusting bar.

4. The hand-operated worm gear height adjustable table according to claim 1, wherein a front side of the table top is provided with a keyboard holder, each of two sides of the keyboard holder is provided with a Z-shaped connecting plate, and each of the two Z-shaped connecting plates is detachably connected to the table top through a connecting assembly.

5. The hand-operated worm gear height adjustable table according to claim 4, wherein the connecting assembly comprises a connector connected to the lower end surface of the table top and a rotating shaft horizontally penetrating through the connecting plate;

an upper end of the connecting plate is horizontally inserted into the connector, a lower side of the connector is provided with a notch for embedding the rotating shaft; a stopper block, a sleeve ring, and a second spring are successively sleeved outside the rotating shaft, the stopper block fits with a side end surface of the connecting plate, and a clamping block is sleeve outside the sleeve ring;

the clamping block is in contact with the stopper block, an end of the rotating shaft away from the connector is provided with an adjusting knob, and an inner side of the adjusting knob is provided with two first protrusions along a circumference of the adjusting knob;

a side end surface of the clamping block facing the adjusting knob is oppositely provided with two arc-shaped second protrusions, the two second protrusions form a circular structure, and a gap is provided between the two second protrusions for clamping the first protrusion; and an end of each of the two second protrusions corresponding to the first protrusion is provided with a guide slope.

6. The hand-operated worm gear height adjustable table according to claim 1, wherein a sliding shaft penetrating through the lower ends of the two second lift arms is provided, and two ends of the sliding shaft are placed in the tracks of the base; and check rings are sleeved outside two ends of the sliding shaft, the check rings are fit with an inner side end surface of the base, and the base is internally provided with cushions at positions corresponding the two ends of the sliding shaft.

7. The hand-operated worm gear height adjustable table according to claim 6, wherein each cushion is provided with a notch at a position corresponding to each of the check rings for embedding the each of the check rings.

8. The hand-operated worm gear height adjustable table according to claim 1, wherein each first lift arm and the corresponding second lift arm are movably connected to each other through a buffer resistance component.

9. The hand-operated worm gear height adjustable table according to claim 8, wherein the buffer resistance component is a second torsional spring.

10. The hand-operated worm gear height adjustable table according to the claim 9, wherein the buffer resistance component is an actuator.

11. The hand-operated worm gear height adjustable table according to the claim 8, wherein the buffer resistance component is an actuator.

* * * * *